United States Patent [19]

Scholl et al.

[11] 4,431,060

[45] Feb. 14, 1984

[54] EARTH WORKING MACHINE AND BLADE CONDITION CONTROL SYSTEM THEREFOR

[75] Inventors: Rolland D. Scholl, Dunlap; Gene B. Easterling, Decatur, both of Ill.

[73] Assignee: Caterpillar Tractor Co., Peoria, Ill.

[21] Appl. No.: 278,491

[22] Filed: Apr. 15, 1981

[51] Int. Cl.[3] ..... E02F 3/76; A01B 63/111

[52] U.S. Cl. ..... 172/4.5

[58] Field of Search ..... 172/2, 4.5, 793, 795, 172/796, 797, 799; 33/313, 328, 351; 37/DIG. 1, DIG. 20; 404/84; 73/432 R, 507, 510

[56] References Cited

U.S. PATENT DOCUMENTS

| | | | |
|---|---|---|---|
| 3,052,997 | 9/1962 | Holland | 172/4.5 |
| 3,229,391 | 1/1966 | Breitbarth et al. | 172/4.5 |
| 3,328,905 | 7/1967 | Page et al. | 172/4.5 X |
| 3,486,564 | 12/1969 | Page et al. | 172/4.5 |
| 3,495,663 | 2/1970 | Scholl et al. | 172/4.5 |
| 3,540,360 | 11/1970 | Snow et al. | 404/84 |
| 3,610,341 | 10/1971 | Swisher, Jr. et al. | 172/4.5 |
| 3,786,871 | 1/1974 | Long et al. | 172/4.5 |
| 3,791,452 | 2/1974 | Long et al. | 172/4.5 |
| 3,896,899 | 7/1975 | Scholl | 172/4.5 |
| 3,899,028 | 8/1975 | Morris et al. | 172/4.5 |
| 3,974,699 | 8/1976 | Morris et al. | 73/432 R |
| 4,140,420 | 2/1979 | Swisher, Jr. et al. | 172/4.5 X |

FOREIGN PATENT DOCUMENTS

| | | | |
|---|---|---|---|
| 1263024 | 2/1972 | United Kingdom | 172/799 |
| 1390066 | 4/1975 | United Kingdom . | |

OTHER PUBLICATIONS

Brochure: "The Grad-Line G.S. 300 Grader Control System", published by Grad-Line, Inc., Woodinville, Wash.

Brochure: "Automatic Blade Control for No. 12F, 14E and 16 Motor Graders", published by Caterpillar Tractor Co. Peoria, Il.

Article: "Grading and Compacting Machinery", Ch 19, *Moving the Earth, the Workbook of Excavation* by H. L. Nichols, 3rd Edition.

*Primary Examiner*—Richard T. Stouffer

*Attorney, Agent, or Firm*—Krass & Young

[57] ABSTRACT

An earth working machine having an earth shaping blade (30) employs a control system for maintaining the blade (30) at a desired slope relative to a reference grade irrespective of lateral movement of the blade (30) or deflection of front and rear frame sections (15, 18). A ground engaging trailing wheel (96) mounted at the rear of the blade (30) senses rotation of the blade (30) relative to the direction of machine travel resulting from rotation or lateral shifting of the blade (30) and operates a potentiometer (124) to produce a control signal proportional to the magnitude of blade rotation. A first pair of accelerometers (128, 130) mounted on the blade (30) for rotation by the trailing wheel (96) produces blade controlling signals respectively corresponding to the change in slope and pitch of the blade (30) relative to the front frame section (15) of the machine. A second pair of accelerometers (42, 44) mounted at transversely spaced locations on the front frame section (15) produce control signals indicative of the roll of the front frame section (15) while an additional accelerometer (90) mounted on the rear frame section (18) produces control signals indicative of the frame pitch. An electronic circuit (94) algebraically combines the control signals for use in controlling the operation of a pair of hydraulic cylinders (38, 40) which maintain the blade (30) at a desired slope.

10 Claims, 9 Drawing Figures

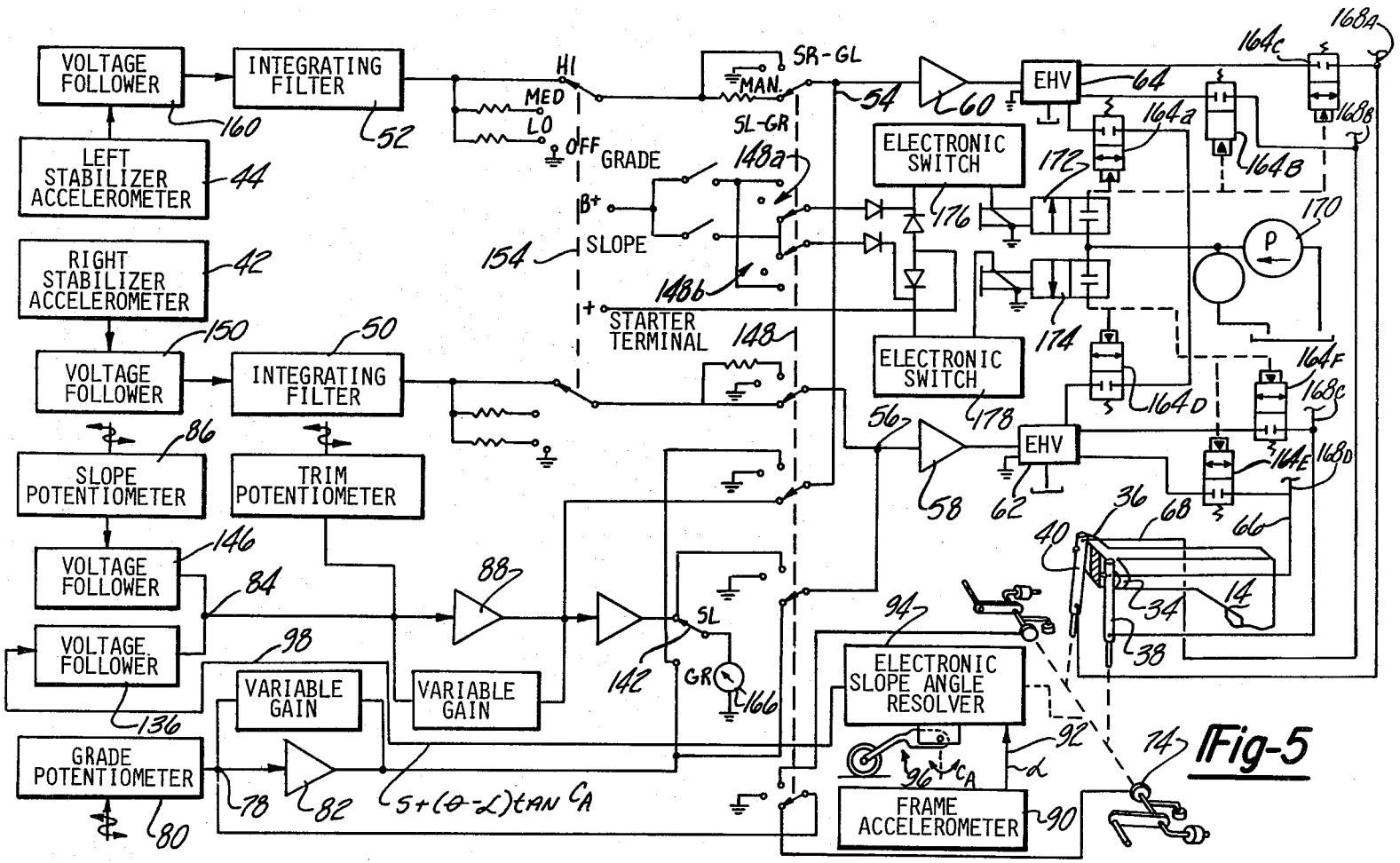
VOLTAGE FOLLOWER
LEFT STABILIZER ACCELEROMETER
RIGHT STABILIZER ACCELEROMETER
VOLTAGE FOLLOWER
SLOPE POTENTIOMETER
VOLTAGE FOLLOWER
VOLTAGE FOLLOWER
GRADE POTENTIOMETER
INTEGRATING FILTER
INTEGRATING FILTER
TRIM POTENTIOMETER
VARIABLE GAIN
VARIABLE GAIN
ELECTRONIC SWITCH
ELECTRONIC SWITCH
EHV
EHV
ELECTRONIC SLOPE ANGLE RESOLVER
FRAME ACCELEROMETER
SR-GL
SL-GR
MAN.
GRADE
SLOPE
OFF
HI
MED
LO
STARTER TERMINAL
SL
GR
B+
P
Fig-5

EARTH WORKING MACHINE AND BLADE CONDITION CONTROL SYSTEM THEREFOR

DESCRIPTION

1. Technical Field

This invention relates generally to earth working machines having an earth shaping tool, and more particularly to a control system for maintaining the tool at a desired slope irrespective of movement of the frame of the machine relative to the tool.

2. Background Art

Recent developments in automatic control systems for cutting implements on earth working machines have permitted motorgraders to achieve closely controlled earth grades at relatively rapid speeds. Closely controlled, relatively rapid grading operations result in substantial economic savings both in operator time and material costs.

Typical prior art systems employed to automatically control the blade of motorgraders are disclosed in U.S. Pat. Nos. 3,786,871 issued Jan. 22, 1974 to Long et al; 3,899,028 and 3,974,699 respectively issued Aug. 12, 1975 and Aug. 17, 1976 to Morris et al; and, 3,896,899 issued July 29, 1975 to Scholl.

Generally these prior art systems are employed with motorgraders of the type having an elongated main frame supported by steerable and tiltable front wheels and driven rear wheels. The earth working blade is mounted on a circularly shaped rotatable frame. The rotatable frame is carried by a drawbar which is pivotally mounted at its forward end on the main frame to allow adjustment of both the slope and pitch of the blade. Previous control systems have employed various sensing devices to detect relative movement between the blade and the drawbar, between the drawbar and the main frame, and between the main frame and the intended grade plane. A typical system employing a ball resolver type sensing device is disclosed in U.S. Pat. No. 3,896,899. Detected relative movement is converted to control signals which operate a pair of hydraulic cylinders that alter the attitude of the blade with respect to the main frame in a manner to maintain the blade at a constant desired slope relative to the grade plane.

While prior art systems using ball resolvers are generally effective in reducing blade slope error under most operating conditions, such systems are not easily rendered capable of recognizing true blade line-of-flight when the machine frame (particularly those of the articulated type) rotates about a vertical axis. Moreover, previous control systems are less than completely accurate in operation due to error introduced by deflection of the various frame components relative to each other. The present invention is directed to overcoming one or more of the problems set forth above.

DISCLOSURE OF THE INVENTION

The present invention overcomes the disadvantages of the prior art control systems by providing a discrete angular position sensor means, blade circle angle detector means in the form of a trailing wheel mounted on the blade, an electronic resolver means responsive to inputs from the position sensors and the trailing wheel to produce a control signal and control means employing the control signal to maintain the blade at a constant, preselected slope in spite of deflections in blade supporting frame components or relative lateral movement between the fore and aft sections of a motorgrader having an articulated type frame.

BRIEF DESCRIPTION OF THE DRAWINGS

FIG. 5 is a combined block and diagrammatic view of the blade condition control system;

BEST MODE FOR CARRYING OUT THE INVENTION

Figure 1A:
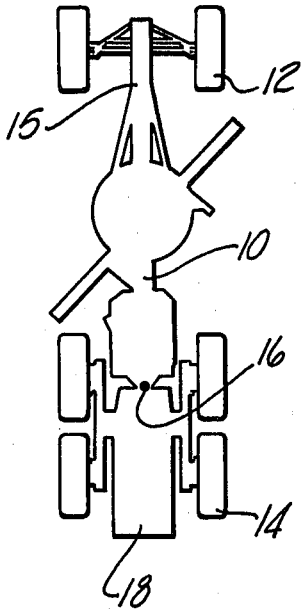
FIGS. 1A, 1B and 1C are plan views of a motorgrader machine having an articulated frame and employing the blade condition control system of the present invention and depicting the machine in various frame operating modes.
Figure 1B:
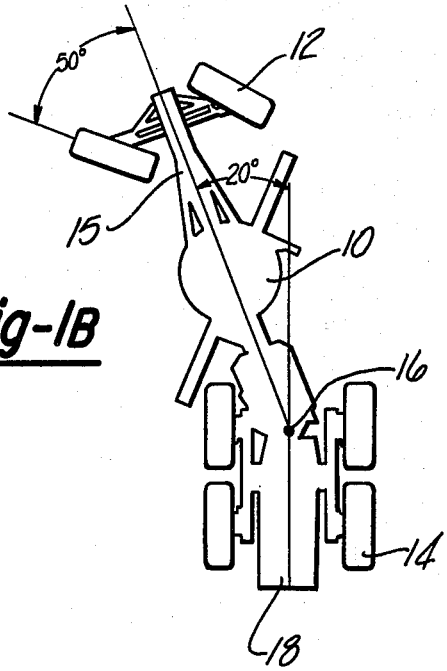
Figure 1C:
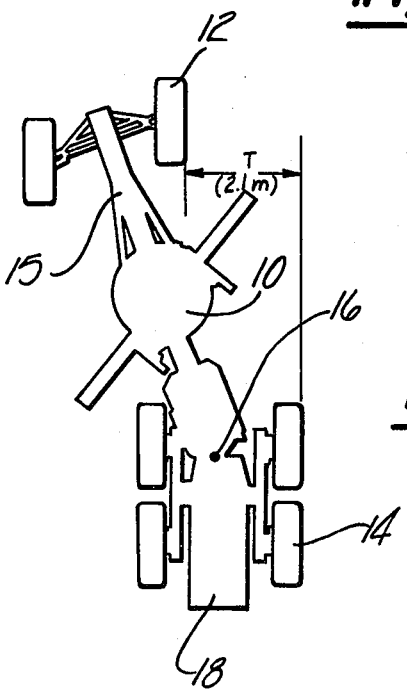
Figure 2:
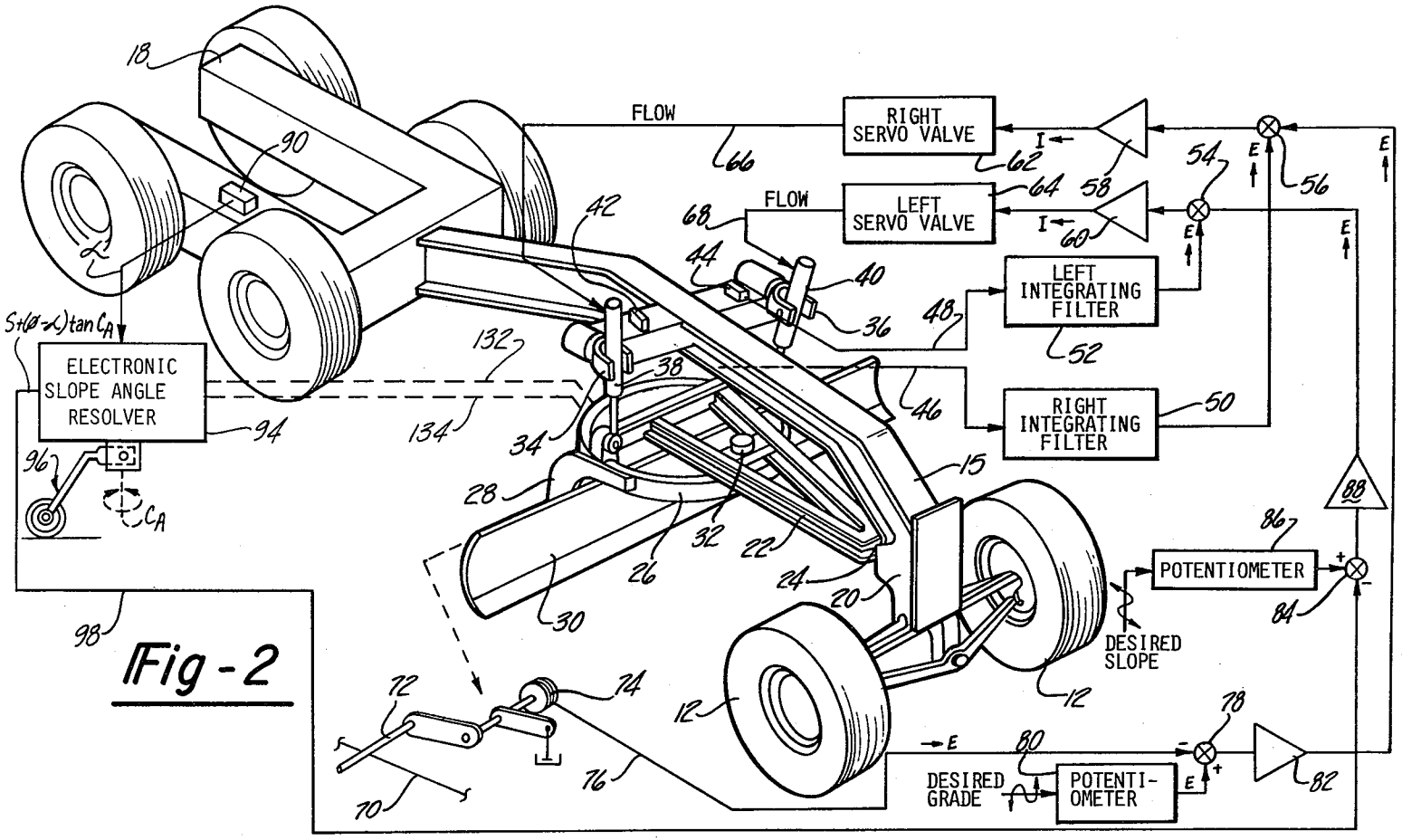
FIG. 2 is a combined block and fragmentary perspective view of the machine shown in FIG. 1 along with the control system of the present invention.

Referring first to FIGS. 1 and 2, a motorgrader includes an elongated frame 10 supported by a pair of steerable front wheels 12 and two pair of driven rear wheels 14 for movement over the earth. The frame 10 may be of the articulated type comprising a front section 15 having one end thereof pivotally connected at a pivot point 16 to a rear frame section 18 for pivotal movement about a vertical axis extending through pivot point 16. The front frame section 15 may be pivoted as shown in FIG. 1B to facilitate turning or for carrying a full blade load around a corner. Under certain operating conditions, it may be desirable to maintain the frame in an articulated position with the front wheels 12 oriented parallel to the rear wheels 14 as shown in FIG. 1C.

Frame section 15 is provided with a vertically extending bolster 20 at the forward end thereof upon which the front wheels 12 are mounted in the normal manner. A longitudinally extending drawbar 22 is pivotally connected by means of a ball joint 24 to the bolster 20. Ball joint 24 allows pivotal movement of the drawbar 22 about transverse and longitudinal axes. A circle frame 26 is mounted at the rear of drawbar 22 for rotational movement about an axis extending perpendicular to the longitudinal axis of drawbar 22. A pair of transversely spaced blade brackets 28 mount an elongate earth working blade 30 on circle frame 26 in a conventional manner. A gear housing 32 has a pinion (not shown) which engages teeth on circle frame 26 to rotate the latter and thus position the blade 30 at any desired angle relative to the longitudinal axis of drawbar 22. The drawbar 22 is further stabilized by a conventional side shift mechanism (not shown).

Vertically located above the blade 30 and secured on front frame section 15 is a righthand bracket 34 and a lefthand bracket 36 which extend laterally outward on opposite sides of front frame section 15. Adjustable supporting means consisting of a pair of hydraulic cylinder members 38 and 40, respectively, are respectively gimbal mounted on brackets 34 and 36, with the extensible rod portions of the cylinders 38 and 40 being connected to laterally spaced points on the drawbar 22 so that the position of the cylinder rods determines the orientation of the blade 30 relative to a horizontal reference plane.

A pair of accelerometers 42 and 44 are respectively secured to left and righthand brackets 34 and 36 for producing signals which have a magnitude proportional to the time rate of change of velocity of the corresponding brackets 34 and 36. The details of construction of the accelerometers 42 and 44 are well known in the art and therefore need not be described in detail herein. However, accelerometers 42 and 44 may be similar to that commercially available from the Systron-Donner Corporation, Model 4310.

The outputs of accelerometers 42 and 44 are respectively delivered on lines 46 and 48 to corresponding integrating filters 50 and 52. Since the output signals on lines 46 and 48 are proportional to the time rate of change of the velocity of brackets 34 and 36, the output of integrating filters 50 and 52 is proportional to the velocity. The outputs of integrating filters 50 and 52 are respectively delivered through amplifiers 60 and 58 to electro-hydraulic valves 64 and 62, the outputs of which are respectively employed to control the cylinders 40 and 38 via hydraulic lines 68 and 66. Because the amount of movement of the output rods of cylinders 38 and 40 is proportional to the velocity of movement of frame brackets 34 and 36, blade 30 is rapidly repositioned to effectively isolate the blade 30 from vertical movement of front frame section 15, thereby maintaining the blade in a constant orientation with respect to a reference plane corresponding to the desired grade.

In addition to being isolated from the movement of the front frame section 15, the blade 30 may be positioned to produce the desired grade. In this connection, grade refers to the depth of cut or the distance from a hypothetical reference plane, while slope refers to the angle of the cutting edge of blade 30 with respect to such reference plane. For maintaining the correct grade, a wand mechanism is employed, such as the mechanism disclosed in detail in U.S. Pat. No. 3,495,633. For purposes of the present disclosure, it is sufficient to note that an external grade wire 70 is contacted by a wand 72 which is linked to the shaft on a potentiometer 74. Because one portion of the potentiometer 74 is fixed with reference to the blade 30, the output of potentiometer 74 is proportional to the position of its end of the blade 30 with respect to wire 70. Thus, an output from potentiometer 74 can be transmitted by a conductor 76 to a summing junction 78, a second input to junction 78 being formed from a manually operable potentiometer 80 which allows the operator to adjust blade 30 to the desired grade. Thus, so long as one end of blade 30 resides in the proper relationship with the grade wire 70, the output of summing junction 78 is zero; however, when the position of blade 30 diverges from the desired grade, summing junction 78 produces a proportional output which is amplified by amplifier 82 and fed to summing junction 56 along with the input from integrating filter 50. Thus, cylinder 38 operates to compensate for the combined effect of unwanted vertical movement of frame bracket 34 and the divergence of the blade 30 from the desired grade.

Figure 3:
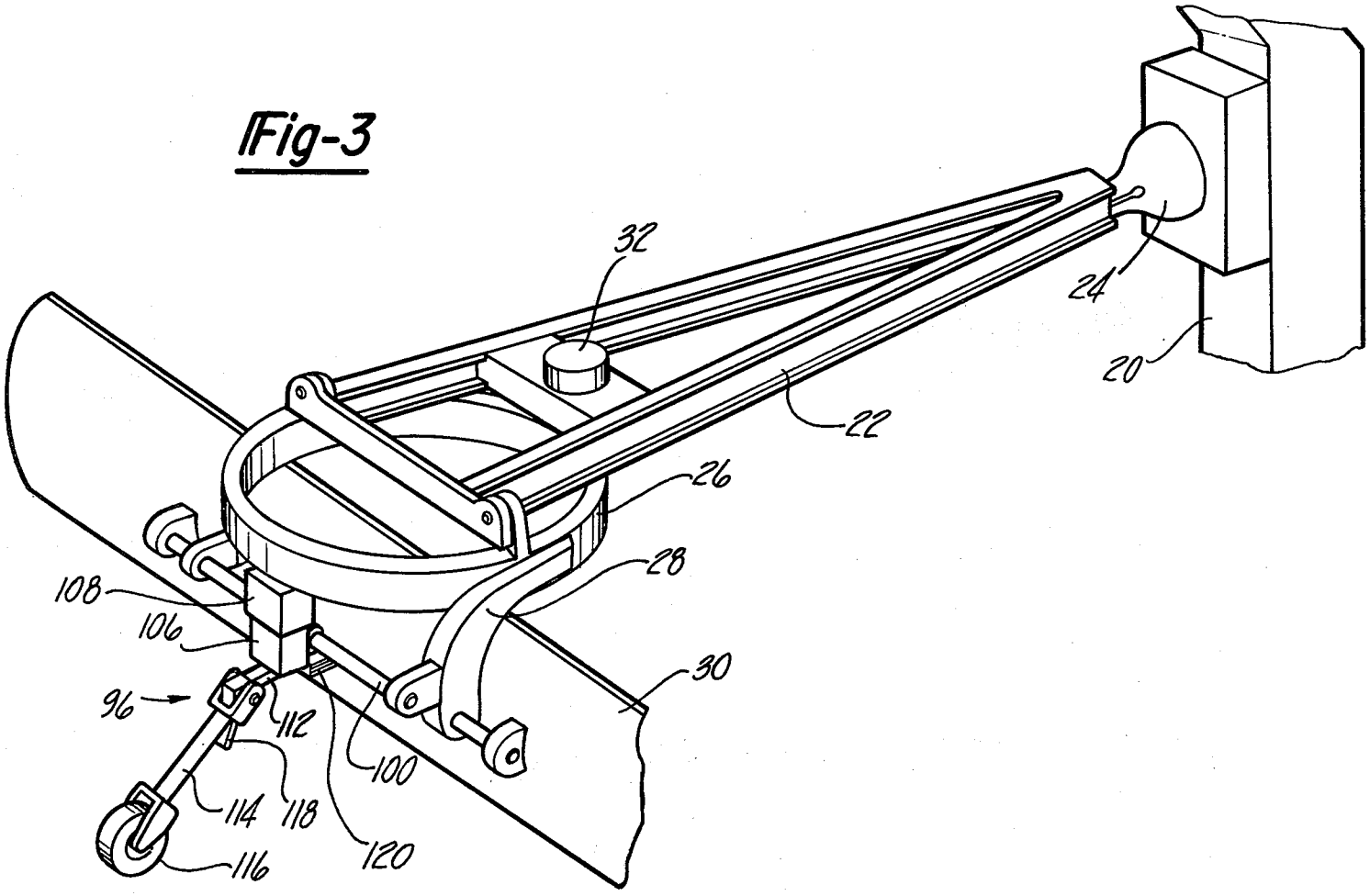
FIG. 3 is a fragmentary, perspective view of a portion of the machine shown in FIGS. 1 and 2 along with a portion of the blade condition control system of the invention.
Figure 4:
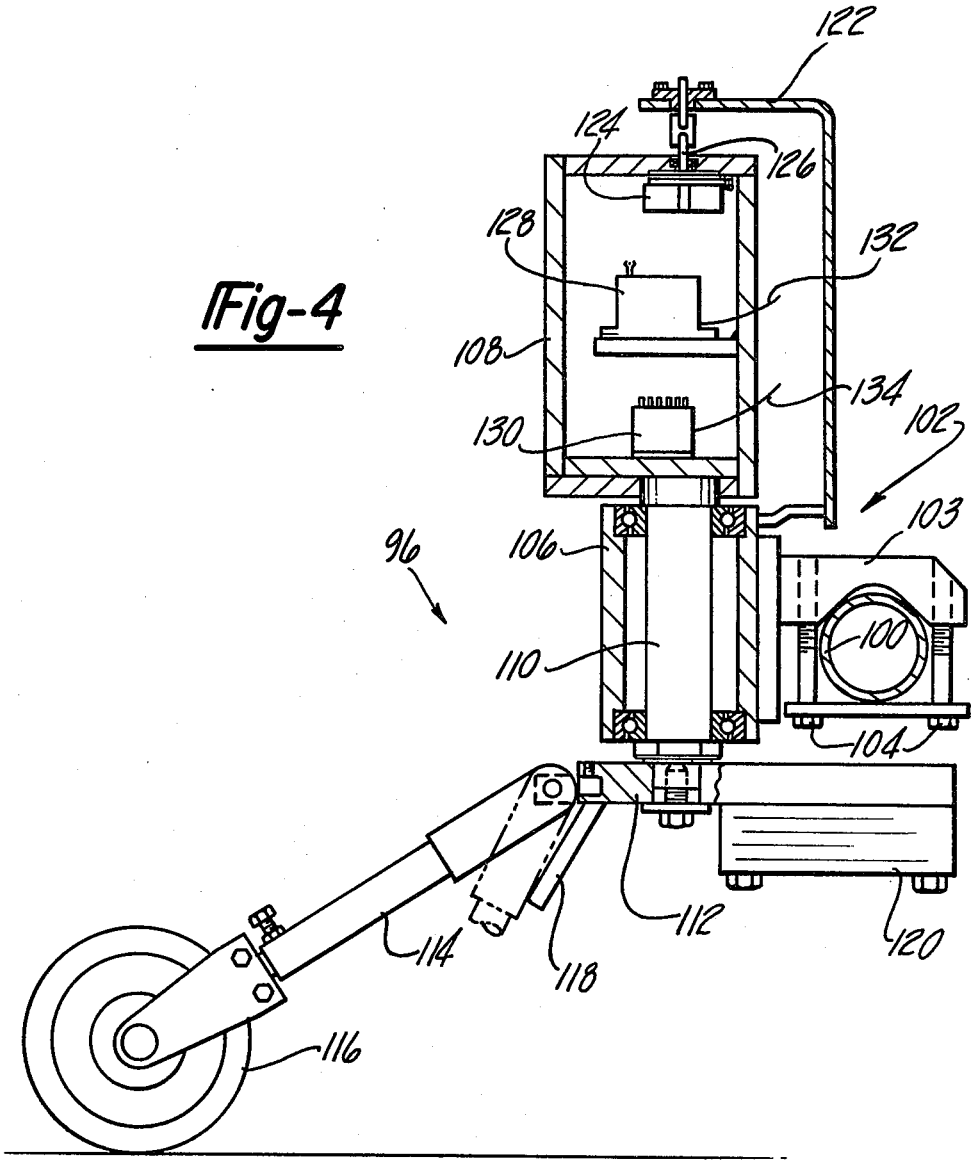
FIG. 4 is a fragmentary, side view of the trailing wheel assembly, parts being broken away in section for clarity.

In order for the control system to generate a signal proportional to the correct blade slope, electronic slope angle resolver means 94 is provided in combination with blade circle angle detector means in the nature of a ground engaging trailing wheel assembly 96. Referring now particularly to FIGS. 2, 3 and 4, the ground engaging trailing wheel assembly 96 is removably mounted by means of a bracket assembly 102 to a transversely extending rod 100 having the opposite ends thereof secured to blade bracket 28 at the rear of blade 30. Bracket assembly 102 includes a U-shaped portion 103 secured to rod 100 by means of bolts and cross piece 104. Bracket assembly 102 further includes a rearwardly extending, box-shaped portion 106 having a hole extending vertically therethrough within which there is received a shaft 110. Shaft 110 is rotatable within the box-shaped portion 106 about an axis which extends perpendicular to the top of circle frame 26. An elongate spacer 112 is connected intermediate its ends for rotation on the lower end of shaft 110. The forward extremity of spacer 112 has a plurality of individual counterweights 120 removably secured thereto. The rearward end of spacer 112 has one end of an elongate connection member 114 mounted thereto for pivotal movement about an axis extending perpendicular to the longitudinal axis of shaft 110. Connecting member 114 may be constructed in a telescoping manner so as to allow adjustment of the overall length thereof. The lower end of connecting member 114 has a ground engaging guide member in the nature of a wheel 116 rotatably mounted thereon. A stop member 118 is secured to the underside of the rearward end of spacer 112 in order to limit the forward swinging movement of connecting member 114.

A box-shaped, enclosed support 108 is mounted on the upper end of shaft 110 for rotation along with the latter. A pair of angular position sensors in the nature of pitch and slope accelerometers 128 and 130 are mounted within the support housing 108. Accelerometers 128 and 130 are similar in construction to that previously described and may each comprise a Systron-Donner Module No. 3410. The sensing axis of slope accelerometer 130 extends parallel to a plane defined by the rotation of the cutting edge of blade 30, while the pitch accelerometer 128 has the sensing axis thereof aligned perpendicular to the sensing axis of slope accelerometer 130 so as to provide signals proportional to the pitch of the blade 30 about its longitudinal axis. The slope accelerometer 130 produces signals proportional to the angular position of blade 30 corresponding to the blade's slope.

A potentiometer 124 is secured to the upper wall of support housing 108 and has an adjustable input shaft 126 thereof stationarily secured to a stationary support member 122 which is connected to the box-shaped portion of bracket assembly 102. From the foregoing, it can be appreciated that as the blade 30 is rotated on circle frame 26, shaft 110 rotates to pivot the support housing 108 and thus the potentiometer 124 and accelerometers 128 and 130.

As a further part of the control system, angular position sensing means consisting of an additional accelerometer 90, similar in construction to that previously described, is mounted on the rear frame section 18 and has the sensing axis thereof extending in a direction parallel to the direction of travel of the machine. The frame accelerometer 90 produces output signals proportional to the angle of inclination of the longitudinal axis of the rear frame section 18 with respect to the reference plane mentioned previously.

Figure 7:
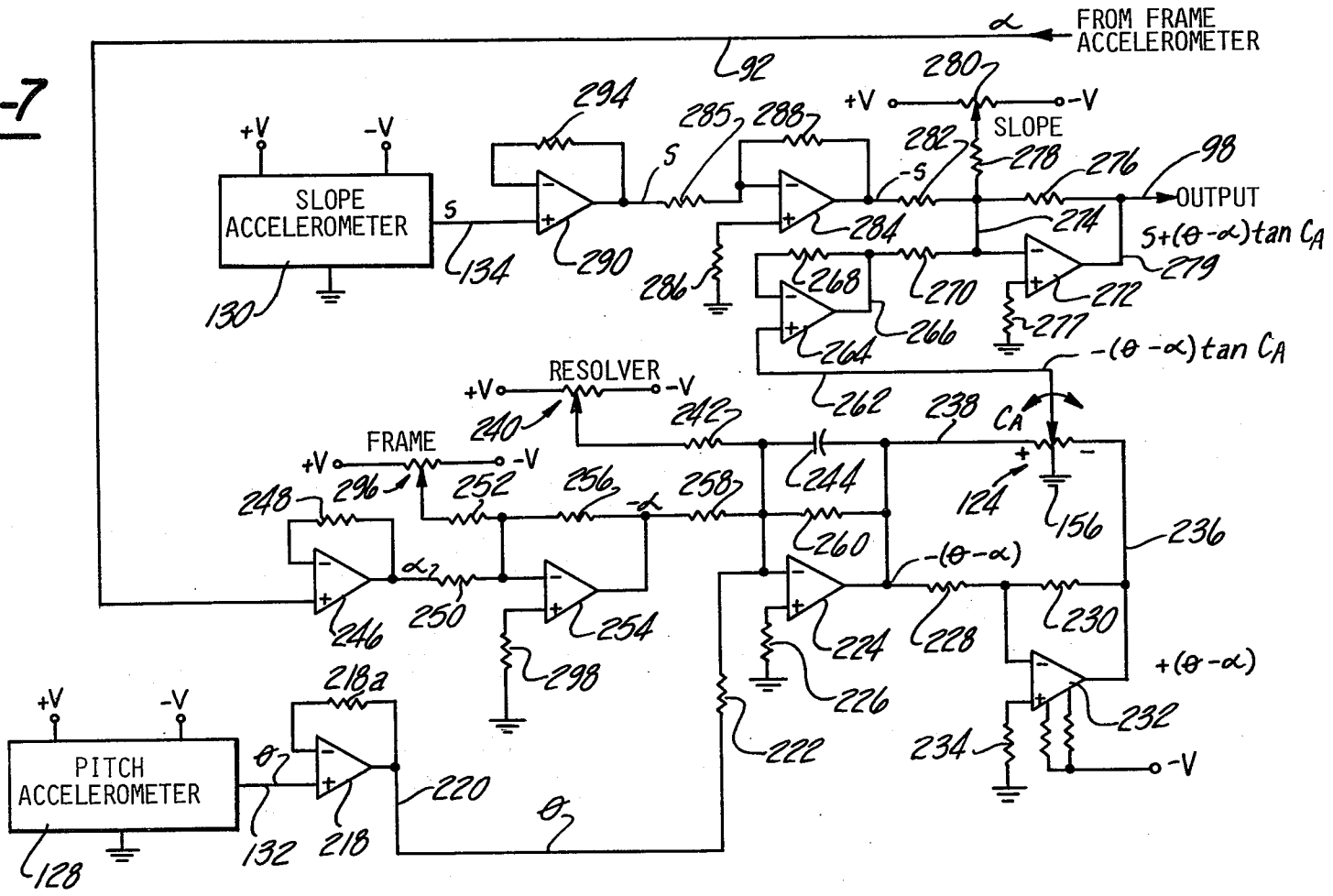
FIG. 7 is a combined block and detailed schematic diagram of the electronic slope angle resolver portion of the control system shown in FIG. 5.

Attention is also now temporarily directed to FIG. 7 wherein the construction of the electronic slope angle resolver means 94 is shown in more detail. The resolver 94 receives control signals from the frame accelerometer 90 via line 92, as well as from the slope accelerometer 130 and the pitch accelerometer 128. Signals received from the frame accelerometer 90 on line 92 are delivered to the positive input of an operational amplifier 246, the negative input of which is coupled through resistor 248 to the output thereof. Output control signals produced by the pitch accelerometer 128 are delivered via line 132 to the positive input of op-amp 218, the negative input thereof being coupled through 218A to the output thereof. Op-amps 218 and 246 comprise voltage followers. The output of op-amp 246 is delivered through resistor 250 to the negative input of op-amp 254. The offset of the signal delivered to the negative input of op-amp 254 is adjusted by means of potentiometer 296 which is connected through resistor 252 to the negative input of op-amp 254. Op-amp 254 has the positive input thereof connected through resistor 298 to ground and functions to invert the signal received on the negative input thereof. The output of op-amp 254 is delivered through resistor 258 to the negative input of a summing op-amp 224. The output of op-amp 218 is also delivered via line 220 through resistor 222 to the negative input of summing op-amp 224. The voltage offset (bias) present on the negative input of op-amp 224 is adjusted by means of potentiometer 240. Thus, the signals output from op-amps 218 and 254 are combined at the negative input of op-amp 224. The positive input of op-amp 224 is connected via resistor 226 to ground and the output thereof is delivered to the positive side of poteniometer 124 via line 238 and to the negative side of potentiometer 124 through the output of op-amp 232. Additionally, the output of op-amp 224 is delivered through resistor 228 to the negative input of op-amp 232, the positive input thereof being connected to ground via resistor 234. Op-amp 232 inverts the signal output from op-amp 224.

The contact position of the wiper portion of tangent function potentiometer 124 relative to the central ground 156 is determined by the rotational position of stationary portion 126. The position of the wiper portion of potentiometer 124 determines the relative magnitude of the frame and pitch signals which are delivered to line 262.

The magnitude of signals delivered to line 262 is proportional to the tangent of rotation of trailing wheel assembly 96. As will be discussed later in more detail, the amount of rotation of the trailing wheel assembly 96 corresponds to the degree of rotation of blade 30 about a reference axis extending perpendicular to the previously mentioned reference plane. Consequently, if the angle of rotation defined by the trailing wheel assembly 96 is designated at $C_A$ and the angles corresponding to control signals produced by frame accelerometer 90 and pitch accelerometer 198 are respectively designated as $\alpha$ and $\theta$, the magnitude of the signal present on line 262 is approximately equal to $$-[(\theta)-(\alpha)] \tan C_A.$$

The signal present on line 262 is delivered to the positive input of op-amp 264 which functions as a voltage follower. The output of op-amp 264 is connected via line 266 to the negative input thereof through line 268 as well as to the negative input of op-amp 272 through resistor 270. Simultaneous with the processing of the $\theta$ and $\alpha$ signals as described above, the output signal developed by the slope accelerometer 130, hereinafter designated as S, is delivered to the positive input of op-amp 290 which functions as a voltage follower. The output of op-amp 290 is connected in feedback through resistor 294 to the negative input thereof, and is also delivered to the negative input of an inverting op-amp 284 through resistor 285. The positive input of op-amp 284 is connected to ground through a resistor 286 which the output is connected in a feedback through resistor 288 as well as to the negative input of op-amp 272 through resistor 282 and line 274. The outputs of amplifiers 264 and 284 are connected by resistors 270 and 282 respectively to the inverting input of amplifier 272 where they are summed with an offset signal from potentiometer 280, the wiper of which is connected by resistor 278 to such inverting input. The output on line 98 is a signal representing an algebraic combination of S, $\theta$, $\alpha$, and tan $C_A$. given by the formula $$S+(\theta-\alpha) \tan C_A.$$

This equation is representative of the actual angle at which blade 30 is to cut, relative to the direction of travel of the machine.

As shown in FIG. 2, the output of the resolver means 94 is connected via line 98 to summing junction 84, a second input to summing junction 84 being formed by the output of potentiometer 86. Potentiometer 86 provides the operator with means for manually selecting the desired slope. In other words, summing junction 84 has an output only when the slope of blade 30 diverges away from the desired or preselected slope. The output of summing junction 84 is amplified by amplifier 88 and is delivered to one input of summing junction 54, the other input of which is connected to the output of integrating filter 52. It is thus apparent that amplifiers 60 and 88, in combination with valve 64, define control means for operating cylinder 40 in order to compensate for movement of both front frame section 15 as well as movement of blade 30 relative to front frame section 15 to maintain the slope of blade 30 at the correct angle.

Figure 6:
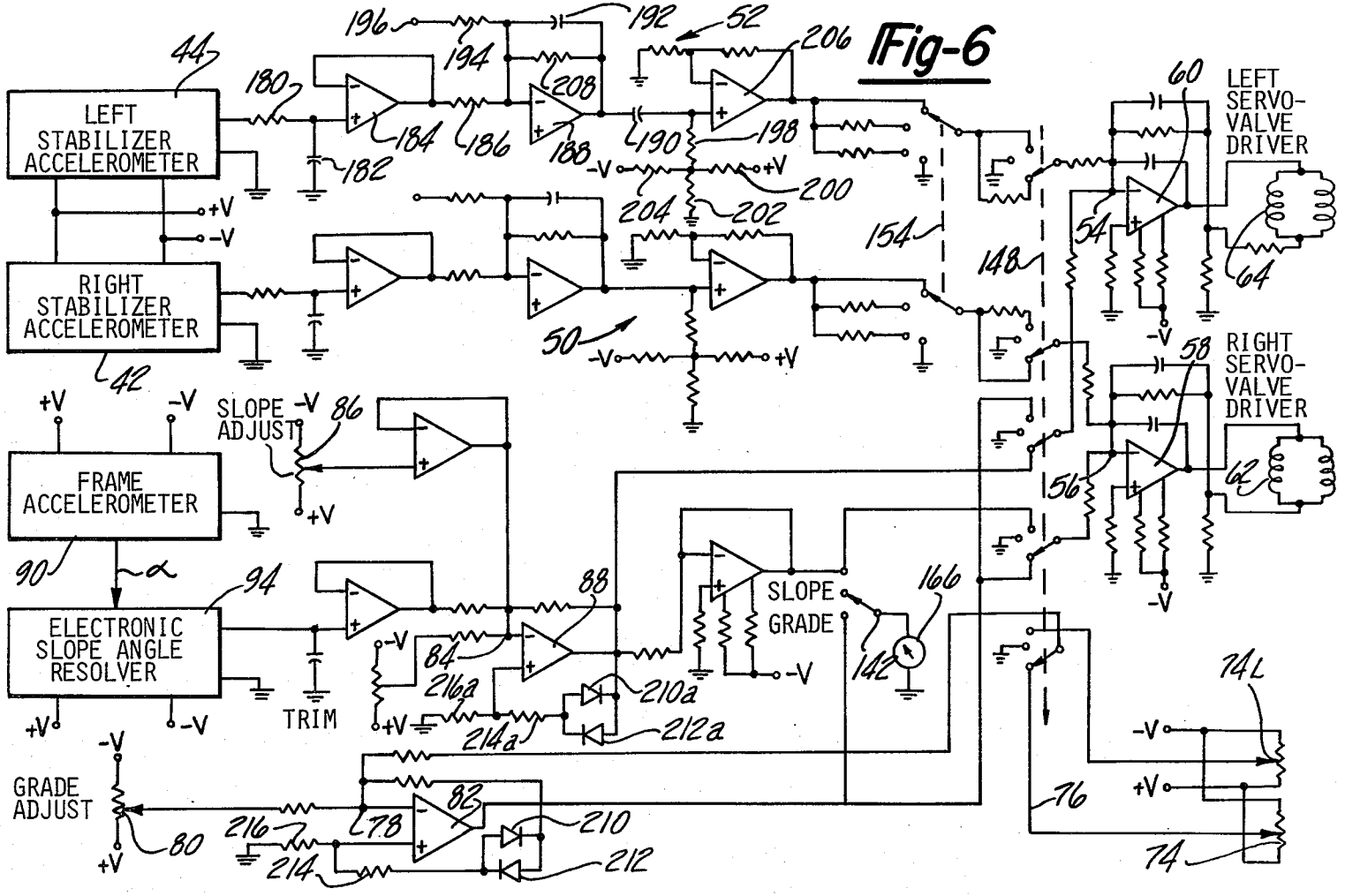
FIG. 6 is a combined block and detailed schematic diagram of a portion of the control system shown in FIG. 5.

Attention is now directed to FIGS. 5 and 6 which depict in more detail the control system shown in FIG. 2. Referring first to FIG. 5, a switch 148 is accessible to the operator of the machine and is used to select one of three operating modes. In the uppermost position, the slope of blade 30 is generally controlled by the righthand cylinder 38 and the grade of the blade is generally controlled by the lefthand cylinder 40. In the lowermost position, the controls are reversed, i.e., the slope is generally controlled by the righthand cylinder 38.

In the central switch position, the circuitry is rendered ineffective and blade control is achieved by valves associated with hydraulic lines 168A–168D. Switch 148 has two decks, indicated at 148A and 148B, such that when switch 148 is in the central or manual position, it turns off hydraulic valves 172 and 174 which in turn move check valves 164A–164F to a closed position so that the sole hydraulic control occurs at connections 168A–168D. When switch 148 is at either of the extreme positions, valves 172 and 174 are moved to the open position whereby a hydraulic fluid under pressure flows from the source 170 to check valves 164A–164F thereby allowing activation of electrohydraulic valves 62 and 64 to respond to control signals.

A sensitivity control 154 is manually set by the operator. Control 154 is a four-position switch, the upper position of which connects accelerometers 42 and 44 directly through to junction points 56 and 54, respectively. In the center two positions, switch 154 switches in different values of resistance in series with the accelerometer output so that the signals from accelerometers 42 and 44 are attenuated. In rough grading operations, the uppermost position of switch 154 is employed, whereas in fine grading operations, one or the other of the center positions is employed. In the lowermost position, the effect of accelerometers 42 and 44 is removed from the circuit.

In order to afford the operator with an indication of the slope and/or grade changes, a meter 166 is provided, along with a two-position switch 142. When the control system is not functioning to correct blade slope, meter 166 provides a zero indication. When, however, the control system is operating to correct blade slope, meter 166 gives an indication of the amount of correction being applied thereto.

As previously indicated, integrating filters 50 and 52 integrate the signals produced by accelerometers 42 and 44, respectively. The constructional details of integrating filters 50 and 52 are shown in more detail in FIG. 6. It may be noted that the signal conditioning circuits between the individual accelerometers 42 and 44 and switch 154 are identical. The output of accelerometer 44 is smoothed by a filter network consisting of a resistor 180 and capacitor 182 and fed through an operational amplifier 184 which serves as a voltage follower to unload the accelerometer circuitry. The acceleration signal passes from the voltage follower 184 through an input resistor 186 to the input of intergrating filter 52.

Filter 52 comprises a first operational amplifier 188, used in an integrating configuration, and a second operational amplifier 206 which serves as a buffer. A capacitor 190 serves an AC coupled between the output of amplifier 188 and the input of amplifier 206. Filter 52 functions to integrate the signal from accelerometer 44, provides an AC couple to buffer amplifier 206, and produces a velocity signal proportional to the acceleration forces sensed by accelerometer 44. The AC couple is needed because the machine frame is not always disposed truly vertical in normal operation. Thus, gravity forces acting on accelerometers 42 and 44 would cause a steady state DC output which, if integrated, would saturate the system. The AC couple provided by capacitor 190 prevents any signal from reaching the input to amplifier 206 regardless of the disposition of the machine frame with respect to vertical, so long as such angle is steady state. When the frame roll angle, and hence the output from integrating amplifier 188, is changing, a signal is delivered by the AC couple provided by capacitor 190 to the input of amplifier 206. The primary purpose of buffer amplifier 206 is to unload the AC couple allowed by capacitor 190.

Accelerometers 44 is disposed on frame section 15 with its sensitive axis disposed vertically, consequently, it will always have a steady state output resulting from the action of gravity on its seismic mass. Such output appears at the input to amplifier 188 which has the particular gain factor depending upon the value of resistor 208 and capacitor 192 in its feedback circuit and the value of input resistor 186. A biasing voltage is applied at the terminal 196 and a particular value is calculated for a bias resistor 194 to compensate for the steady state acceleration signal thereby controlling the output of amplifier 188 so that no signal will pass through capacitor 188.

A bias network consisting of resistors 198, 200, 202 and 204, connected to the noninverting input amplifier 206, serves to compensate for any internal bias of buffer amplifier 206 and insures that it has zero output when no signal is passed by capacitor 188.

Signal conditioning circuitry is associated with the right accelerometer 42 and is identical in function and configuration to the abovedescribed circuitry associated with accelerometer 44 for acceleration signals produced by accelerometer 42.

Control system response is enhanced by a variable gain feature associated with the grade amplifier 82 and slope amplifier 88 that are responsive not only to the magnitude of the output of these amplifiers and hence the magnitude of error signals appearing at their input.

Amplifier 82 employs a regenerative feedback circuit consisting of diodes 210, 212 and resistor 214. Normally, amplifier 82 is biased by a resistor 216 and its output response curve rises gradually for normal error signals. For large grade error signals, however, when the output of amplifier 82 rises above a predetermined level, diode 210 or 212 will conduct, depending upon amplifier output polarity, and the bias of amplifier 82 will be charged to cause its output curve to rise sharply for faster response. Components 210A–216A perform identical functions in the circuit of slope amplifier 88.

INDUSTRIAL APPLICABILITY

It is to be understood that the control system described above may be employed in connection with various types of earth working machines having earth working tools, however, the operation of the system will now be described in connection with its use in a motor grader having an earth grading blade. In operation, the operator first actuates motor switch 148 to render the control system operational such that the slope of the blade 30 is controlled by either cylinder 38 or 40. The sensitivity switch 154 is then set to the desired level in order to adjust the magnitude of signals produced by accelerometers 42 and 44. The desired grade and slope are then selected by the operator by using potentiometers 80 and 86, respectively. Assuming that a grade wire 70 has been installed, the machine is positioned such that the wand 72 is aligned with and engages the grade wire 70. At this point, grading may commence.

Unevenness of the terrain being graded inevitably results in pitch and roll of the front frame section 15. Accelerometers 42 and 44 are operative to produce signals proportional to the degree of roll of the front frame section 15 about its longitudinal axis while accelerometer 90 produces a control signal proportional to the degree of pitch of the rear frame section 18 about an axis extending transverse to the direction of travel. Thus, the control signals produced by accelerometers 42, 44 and 90 are employed to correct blade slope due to pitch and roll of the front frame 10 relative to the desired blade position.

From the previous description, it can be appreciated that the blade 30 is shiftable relative to the front frame section 15 by virtue of the fact that the drawbar 22 is pivotally mounted on the bolster 20 and that the blade 30 is rotatably mounted on the drawbar 22 by circle frame 26. Pivotal movement of the drawbar 22 about a transversely extending axis affects the pitch of the blade 30 about its longitudinal axis; the degree of variance of pitch is sensed by accelerometer 128 which is mounted for rotation along with the trailing wheel assembly 96. Consequently, accelerometer 128, whose sensitive axis extends parallel to the longitudinal axis of drawbar 22, produces control signals which are employed to operate cylinders 38 and 40 in order to correct variations in the pitch of drawbar 22 and thus of circle frame 26.

Since circle frame 26 and drawbar 22 are mounted for pivotal movement about the longitudinal axis of drawbar 22, rolling motion of the drawbar 22, which creates a change in the slope of blade 30, is detected by accelerometer 130. Accelerometer 130 produces a signal proportional to the blade slope angle and has the sensitive axis thereof oriented essentially perpendicular to that of accelerometer 128.

It may be readily appreciated that the sensitive axes of accelerometers 128 and 130 are maintained in fixed relationship relative to the direction of travel of the machine, in spite of rotation of the blade 30 on circle frame 26 or lateral shifting of blade 30 when the frame section 15 is pivoted with respect to the frame section 18 by virtue of the fact that the trailing wheel assembly 96 remains aligned with the forward direction of travel of the machine and therefore causes support housing 108 to rotate when either the circle frame 26 rotates or the entire assembly of the drawbar 22, circle frame 26 and blade 30 are caused to rotate when front frame section 15 is pivoted relative to the rear frame section 18.

The degree of rotation of the blade 30 produced by rotation of the circle frame 26 or pivotal movement of the front frame section 15 is sensed by potentiometer 124 which produces an output signal proportional to the tangent of such angle of rotation. It may be appreciated that potentiometer 124 is operated in accordance with rotation of shaft 110 produced by changes in direction of travel of the blade 30, i.e., rotation of the blade 30 by circle frame 26, or pivotal movement of the front frame section 15, results in rotation of the blade 30 relative to the angular position of trailing wheel assembly 96.

From the foregoing, it is apparent that the trailing wheel assembly 96 remains aligned with the direction of travel of the machine at all times. In some cases, when the machine is traversing a downwardly inclined, relatively steep slope, the trailing wheel assembly 96 may have some tendency to drift from its aligned position relative to the machine's direction of travel.

In order to eliminate this tendency for drift, the counterweight 120 is provided. Additionally, stop member 118 limits the degree of forward pivotal motion of the trailing wheel assembly 96 so as to prevent the wheel from assuming a vertical position when the blade 30 is raised, thereby preventing damage to the assembly 96 when the blade is later lowered.

The resolver means 94 functions to algebraically combine control signals from the accelerometers 90, 128 and 130, as well as potentiometer 124, in order to produce resolution control signals for controlling the cylinders 38 and 40 to maintain constant blade slope in spite of pitch, roll or yaw of either the front frame section 15 or the frame components supporting the blade 30.

Other aspects, objects and advantages of this invention can be obtained by the study of the drawings, disclosure and the appended claims.

We claim:

1. In an earth working machine including an articulated frame (10) adapted for moving over the earth and having a front frame section (15) and a rear frame section (18) pivotally coupled with said front frame section (15), an earth working blade (30), means (22, 26, 28) for mounting said blade (30) for rotation on said front frame section (15), means (38, 40) connected between said blade mounting means (22, 26, 28) and said front frame section (15) for adjustably supporting said blade mounting means (22, 26, 28) on said front frame section (15), apparatus for automatically controlling said supporting means (38, 40) to maintain said blade (30) at a preselected slope relative to a reference plane irrespective of lateral movement of said front frame section (15) relative to said rear frame section (18), the improvement comprising:

blade circle angle detector means (96) for sensing rotation of said blade (30) relative to the line-of-flight thereof, said blade circle angle detector means (96) including a ground engaging guide number (116) and means (102, 110, 112, 114) for mounting said guide member (116) rearward of said blade (30) for rotation about a reference axis extending perpendicular to said reference plane;

angular position sensing means (90) for sensing changes in the inclination of said rear frame section (18) relative to said reference plane;

electronic resolver means (94) for producing a control signal indicative of the degree of both the rotation of said blade (30) relative to said line-of-flight and the inclination of said rear frame section (18) relative to said reference plane; and control means (88, 60, 64) for operating at least one of said adjustable supporting means (38, 40) and maintaining said blade (30) at said preselected slope thereof.

2. The apparatus of claim 1, wherein said guide member mounting means (102, 110, 112, 114) includes:

a support (108, 110, 112) rotatably mounted on said blade mounting means (22, 26, 28) and being rotatable about said reference axis, and a connecting element (114) extending rearwardly away from said blade (30) and being connected to said support (108, 110, 112), said ground engaging guide member (116) being rotatably mounted on said connecting member (114).

3. The apparatus of claim 2, wherein said guide member mounting means (102, 110, 112, 114) includes:

a bracket assembly (102) secured on said blade mounting means (22, 26, 28) and wherein said support (108, 110, 112) includes a shaft (110) journalled for rotation on said bracket assembly (102) and a spacer (112) secured on one end of said shaft (110) and extending radially outward from the longitudinal axis of said shaft (110), said connecting member (114) being elongate and having one end thereof pivotally connected with said spacer (112).

4. The apparatus of claim 3, wherein said guide member mounting means (102, 110, 112, 114) includes a counterweight (120) secured to said spacer (112) in spaced relationship to the longitudinal axis of said shaft (110) opposite said connecting member (114).

5. The apparatus of claim 2, wherein said electronic resolver means (94) includes:

a tangent function potentiometer (124) having first and second portions (124, 126) shiftable relative to each other and being respectively connected to said shaft (110) and said bracket assembly (102).

6. The apparatus of claim 1, including first and second means (128,130) carried by said guide member mounting means (102,110,112,114) for respectively sensing changes in the magnitude of inclination of said blade (30) along first and second axes extending substantially perpendicular to each other and substantially parallel to said reference plane.

7. The apparatus of claim 6, wherein each of said first and second means (128, 130) includes:

an accelerometer (128, 130) adapted for producing first and second sensed output signals respectively indicative of the corresponding change in blade inclination and pitch, and wherein said electronic resolver means (94) includes first circuit means (272) for algebraically combining said first and second output signals with said control signal.

8. The apparatus of claim 7, wherein said angular position sensing means (90) includes accelerometer means (90) for producing a third sensed output signal indicative of the changes in inclination of said rear frame section (18) and wherein said electronic resolver circuit (94) includes second circuit means (224) for algebraically combining said third output signal with said second output signal.

9. The apparatus of claim 1, wherein said sensing means (90) is mounted on said rear frame section (18) and said control means (88, 60, 64) is operably coupled with said resolver means (94).

10. In an earth working machine including an articulated frame (10) adapted for moving over the earth and having a front frame section (15) and a rear frame section (18) pivotally coupled with said front frame section (15), an earth working blade (30), means (22, 26, 28) for mounting said blade (30) for rotation on said front frame section (15), means (38, 40) connected between said blade mounting means (22, 26, 28) and said front frame section (15) for adjustably supporting said blade mounting means (22, 26, 28) on said front frame section (15), apparatus for automatically controlling said supporting means (38, 40) to maintain said blade (30) at a preselected slope relative to a reference plane irrespective of lateral movement of said front frame section (15) relative to said rear frame section (18), the improvement comprising:

blade circle angle detector means (96) for sensing rotation of said blade (30) relative to the line-of-flight thereof, said angle detector means (90) being connected with said blade (30) and being operational to sense the line-of-flight of said blade (30) only when said angle detector means (90) engages the earth;

angular position sensing means (90) for sensing changes in the inclination of said rear frame section (18) relative to said reference plane;

electronic resolver means (94) for producing a control signal indicative of the degree of both the rotation of said blade (30) relative to said line-of-flight and the inclination of said rear frame section (18) relative to said reference plane; and control means (88, 60, 64) for operating at least one of said adjustable supporting means (38, 40) and maintaining said blade (30) at said preselected slope thereof.

* * * * *